US010362842B2

(12) United States Patent
Wilder

(10) Patent No.: US 10,362,842 B2
(45) Date of Patent: Jul. 30, 2019

(54) VARIABLE MAGNETIC CONFIGURATION FOR JEWELRY

(71) Applicant: Christina Wilder, Lehi, UT (US)

(72) Inventor: Christina Wilder, Lehi, UT (US)

( * ) Notice: Subject to any disclaimer, the term of this patent is extended or adjusted under 35 U.S.C. 154(b) by 237 days.

(21) Appl. No.: 15/013,712

(22) Filed: Feb. 2, 2016

(65) Prior Publication Data

US 2016/0219990 A1 Aug. 4, 2016

Related U.S. Application Data

(60) Provisional application No. 62/111,248, filed on Feb. 3, 2015.

(51) Int. Cl.
*A44C 11/00* (2006.01)
*A44C 15/00* (2006.01)

(52) U.S. Cl.
CPC ..... *A44C 15/005* (2013.01); *A44C 11/002* (2013.01); *A44C 15/001* (2013.01); *A44D 2203/00* (2013.01)

(58) Field of Classification Search
CPC ..... A44C 15/005; A44C 11/00; A44C 15/001; A44D 2203/00
USPC ..... 63/4, 38, 41; 59/78
See application file for complete search history.

(56) References Cited

U.S. PATENT DOCUMENTS

| | | | | |
|---|---|---|---|---|
| 4,901,405 | A | 2/1990 | Grover et al. | |
| 5,195,335 | A | 3/1993 | Hart | |
| 5,806,346 | A | 9/1998 | Schlinger et al. | |
| 6,962,063 | B1 | 11/2005 | Pearl | |
| 7,654,112 | B2 * | 2/2010 | Pons | A44C 5/2095 63/21 |
| 8,661,627 | B2 | 3/2014 | Fuhrman et al. | |
| 8,752,252 | B2 | 6/2014 | Ninomiya et al. | |
| 8,763,357 | B1 * | 7/2014 | Arnone | A44C 27/00 59/35.1 |
| 2006/0048543 | A1 * | 3/2006 | Kessler | A44C 5/2076 63/40 |

* cited by examiner

*Primary Examiner* — Jack W Lavinder
(74) *Attorney, Agent, or Firm* — Knobbe Martens Olson & Bear LLP

(57) ABSTRACT

An article of jewelry having a chain that is comprised substantially of non-magnetizable links, but having one or more magnetizable links in designated locations in the chain, and having ornamentation on the chain, wherein magnets are placed behind the ornamentation, and wherein the magnets can be placed at various magnetizable links allowing for the creation of a variety of self-contained variable configurations of the article of jewelry.

12 Claims, 9 Drawing Sheets

VARIABLE MAGNETIC CONFIGURATION FOR JEWELRY

CROSS-REFERENCE TO RELATED APPLICATIONS

This application claims priority to U.S. Provisional Application No. 62/111,248, filed Feb. 3, 2015, the disclosure of which is incorporated herein by reference.

BACKGROUND OF THE INVENTION

Field of the Invention

Certain aspects of the present invention relate generally to articles of jewelry having variable configurations. Methods for re-configuring articles of jewelry are also described.

Description of the Related Art

The use of magnets in jewelry for the purpose of interchangeability or as a clasping mechanism is know. Magnets integrated into jewelry are used as a clasping mechanism to provide ease for clasping the jewelry (for example, U.S. Pat. Nos. 4,901,405; 5,806,346; 8,752,252; 8,661,627). In these examples, the magnets are placed on the ends of the jewelry chain. The magnetic clasps function in such a way that when the opposite ends of the chain are brought in close proximity, the magnets attract and the result is a simple magnetic clasp, wherein the ends of the chain attach through magnetic attraction.

Another use of magnets in jewelry is for the detachment or attachment of additional chains, pieces, or pendants. In U.S. Pat. No. 5,806,346, for example, a first magnet is placed in a designated location on the jewelry, and a second magnet is placed within a detachable ornament. In this way, the ornament is readily removable from the article of jewelry by physically removing the ornament from the magnetic field. An entirely different, detachable ornament having a magnet attached thereto can then be replaced by putting it within close proximity of the magnet located on the jewelry. The ornament can include a pendant, additional chains, or any other common ornaments that modifies the ornamental appearance of the jewelry.

Another proposed use of magnets in jewelry is where magnets are placed along a string of beads (for example, U.S. Pat. Nos: 5,195,335 and 6,962,063). In these examples, the magnetic jewelry provides for a string of magnetic and non-magnetic beads, wherein the magnetic beads are attracted to one another. The magnetic beads have an aperture therethrough through which a string may pass to hold the beads.

SUMMARY OF THE INVENTION

The present invention relates to jewelry having one or more magnets and one or more magnetizable links in the jewelry, which enables the jewelry to undergo various configurations.

In one embodiment of the invention, the article of jewelry has all of the ornamental features self-contained within the jewelry, such that there is no need to detach or re-attach any free standing or separate pieces of ornamentation. Thus, various configurations can be made by changing which magnet is attracted to which magnetizable link.

Some aspects of the invention may be made with reference to the following embodiments.

In some embodiments is a jewelry article configured for variable configurations, wherein the article comprises a jewelry chain made substantially of links that are not magnetizable; one or more magnets, wherein the one or more magnets are interspersed along the jewelry chain; and one or more magnetizable chain links, configured to attach to the one or more magnets, wherein the one or more magnetizable links are interspersed among the jewelry chain.

In some embodiments the jewelry chain comprises non-magnetizable metal selected from the group consisting of gold, white gold, silver, aluminum, and platinum.

In some embodiments, the one or more magnetizable chain links are selected from the group consisting of iron, cobalt, nickel, and alloys thereof In some embodiments, at least one of the one or more magnetizable chain links are plated with a non-magnetizable metal selected from the group consisting of gold, silver, and platinum.

In some embodiments, the one or more magnets is affixed to an ornamental feature.

In some embodiments, the one or more magnets is placed within an ornamental feature.

In some embodiments is a method of re-configuring jewelry, comprising providing the article of jewelry, wherein the article of jewelry comprises a jewelry chain made substantially of links that are not magnetizable; one or more magnets, wherein the one or more magnets are interspersed along the jewelry chain; and one or more magnetizable chain links, configured to attach to the one or more magnets, wherein the one or more magnetizable links are interspersed among the jewelry chain; and moving the one or more magnets to one or more magnetizable links, wherein the one or more magnetizable links is attracted to a magnetic field created by the one or more magnets, and wherein the article of jewelry is held into place in a new configuration due to the magnetic attraction.

BRIEF DESCRIPTION OF THE DRAWINGS

Features, aspects, and embodiments are described in conjunction with the attached drawings, in which.

DETAILED DESCRIPTION OF PREFERRED EMBODIMENTS

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different jewelry pieces having variable magnetic configurations, some of which are illustrated by way of example in the figures and in the following description of the preferred aspects. The detailed description and drawings are merely illustrative of the disclosure rather than limiting, the scope of the disclosure being defined by the appended claims and equivalents thereof Jewelry is generally made of two types of chains. The first type is created by placing a plurality of elements along a flexible string. These elements include beads, pearls, or other common ornamental features used to make a jewelry chain. The beads generally have central throughbores or apertures through which a flexible string can pass. The second type of jewelry chain is a chain comprised of a plurality of connected links, wherein the links are generally toroidal in shape, and wherein one link is connected to an adjacent link by passing through the center of the adjacent link. The links are made of a material that is common in jewelry, such as gold, silver, or platinum.

The articles and methods described herein comprise an article of jewelry having a chain comprised of a plurality of links and may include various ornamental pieces attached thereto. In one embodiment, the chain is comprised substantially of non-magnetizable metal links, with one or more magnetizable metal links interspersed in designated locations throughout the chain. The chain also has ornamental pieces connected thereto, and one or more of the ornamental pieces have magnets placed behind them, such that the designated placement of the magnets provides for various configurations of the article of jewelry by magnetic attractive forces of the magnets to the various magnetizable links.

Figure 1:
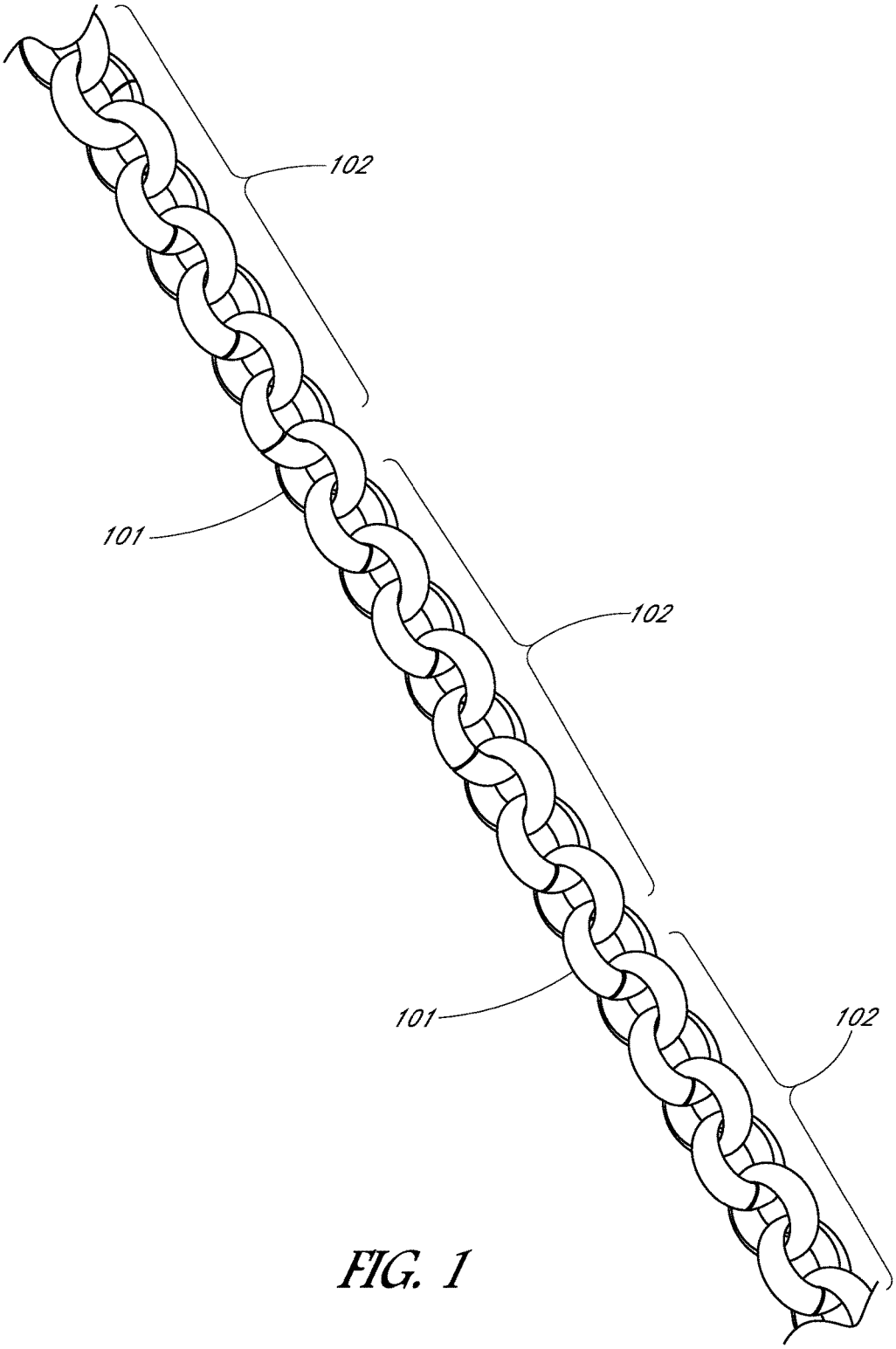
FIG. 1 illustrates an example of a jewelry chain comprising substantially non-magnetizable links, but having a few designated links that are magnetizable.

FIG. 1 illustrates the chain of the article of jewelry. The chain includes some non-magnetizable metal links 102, which are links comprised of non-magnetizable material, wherein such material can include, for example, gold, silver, platinum, aluminum or other non-magnetizable metals. In some embodiments, the non-magnetizable links 102 comprise non-magnetizable material that is a non-metal, including, for example, polymers, plastics, minerals, or other materials suitable in the manufacture of a necklace chain. For purposes of this invention, the term non-magnetizable refers to a material that does not become substantially magnetized when subjected to an externally applied magnetic field. In many advantageous embodiments, the chain will include mostly non-magnetizable links 102, such as 90% or more non-magnetizable links 102. Because the chain of the jewelry is comprised substantially of the non-magnetizable links 102, the chain is less likely to become tangled or otherwise disheveled by magnetic attraction when a magnet is present.

Interspersed among the non-magnetizable links 102 are one or more designated magnetizable links 101. For purposes of this invention, the term magnetizable refers to a "soft" ferromagnetic or ferromagnetic material, which is a material that is capable of being magnetized when subjected to an externally applied magnetic field, but that does not tend to stay magnetized in the absence of an externally applied magnetic field. Soft magnetic materials, as described throughout this disclosure, have a relatively low coercivity. As defined herein, a material with low coercivity has a coercivity of less than 900 Oersted (Oe (kA/m)). Therefore, magnetizable links 101 can be created, for example, from materials such as iron (2 Oe), nickel (less than 290 Oe), cobalt (less than 900 Oe), or combinations and alloys thereof, such that the material is magnetizable with a low coercivity.

The magnetizable links 101 are optionally plated or coated in the same non-magnetizable material that is used to create the non-magnetizable links 102, giving the appearance that the magnetizable links 101 are of the same material as the non-magnetizable links 102, yet retaining their magnetizable properties. The chain can have one or more magnetizable links 101, and preferably fourteen magnetizable links 101. The number and spacing of the magnetizable links 101 among the non-magnetizable links 102 provides for the various configurations of the article of jewelry depending on the placement and presence of magnets.

Figure 2:
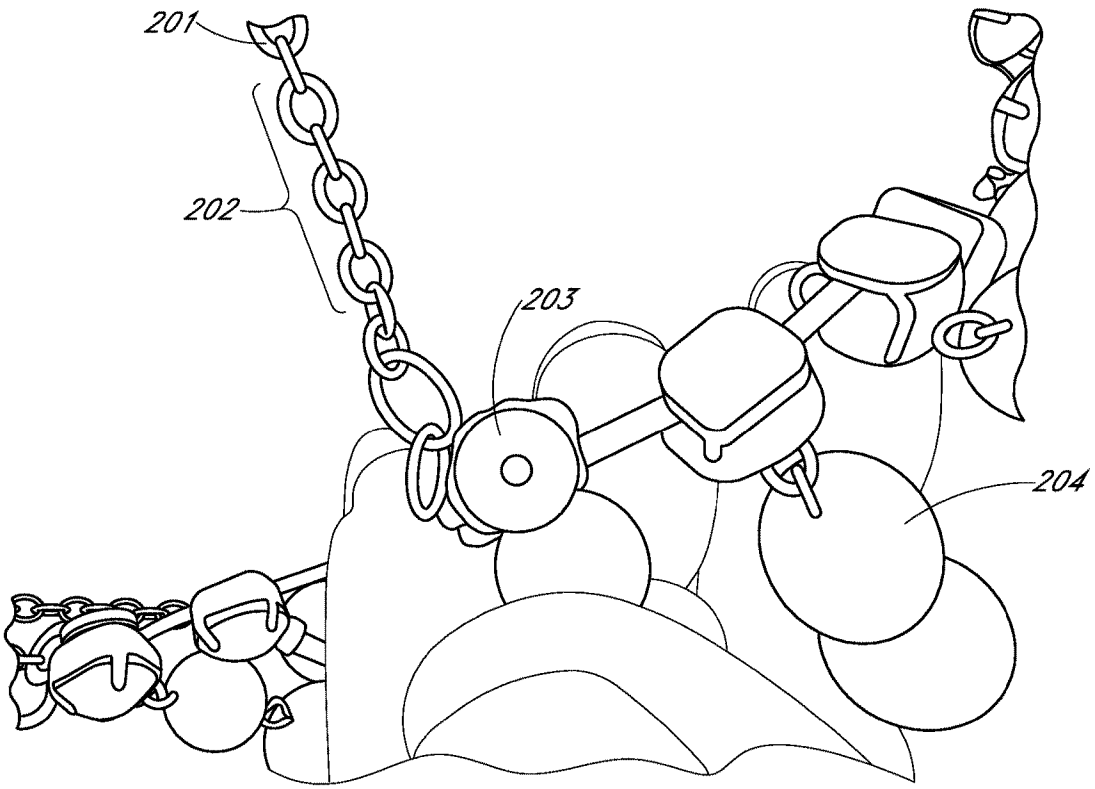
FIG. 2 illustrates an example of the placement of magnets on the underside of an ornamental feature.

FIG. 2 illustrates the placement of magnets 203 behind ornamental features 204 of the article of jewelry. As used herein, the term magnet refers to a permanent magnet made of a "hard" magnetic material. As used herein, a hard magnetic material has a relatively high coercivity of greater than 900 Oe. Thus, permanent magnets having a sufficiently high coercivity include, for example, neodymium magnets (NdFeB having a coercivity of 10,000-12,000 Oe), samarium-cobalt magnets (40,000 Oe), or any other suitable permanent magnet that has a relatively high coercivity such that it produces its own persistent magnetic field in the absence of an externally applied magnetic field.

The chain of the article of jewelry may comprise ornamental pieces or features 204. There can be one or more ornamental pieces or features 204. A magnet 203 is affixed or connected to an ornamental piece or feature 204, such that the magnet 203 is concealed. Optionally, a magnet 203 may be placed within a bead or other feature of the ornamental piece 204. The magnet 203 is configured to attract the one or more magnetizable links 201, such that the when the magnet 203 is placed within close proximity of the one or more magnetizable links 201, the attractive force causes the magnetizable link 201 to pull toward and magnetically attach to the magnet 203. However, the magnet 203 does not attract the non-magnetizable links 202. In this way, various configurations of the article of jewelry are achieved. The article of jewelry comprises one or more ornaments 204 having one ore more magnets 203 concealed or attached thereon, and preferably four ornaments having magnets placed thereon. The one or more ornaments 204 having one or more magnets 203 affixed or connected thereon are located in specific designated locations such that the attraction to the complementary magnetizable links 201 provides for aesthetically pleasing configurations of the article of jewelry. Those of skill in the art would recognize that the type of magnet used could be any type of magnetic material that is strong enough to create a strong attraction to the magnetizable link, yet small enough that they are not excessively heavy or burdensome, and would include, for example, neodymium magnets.

Figure 3:
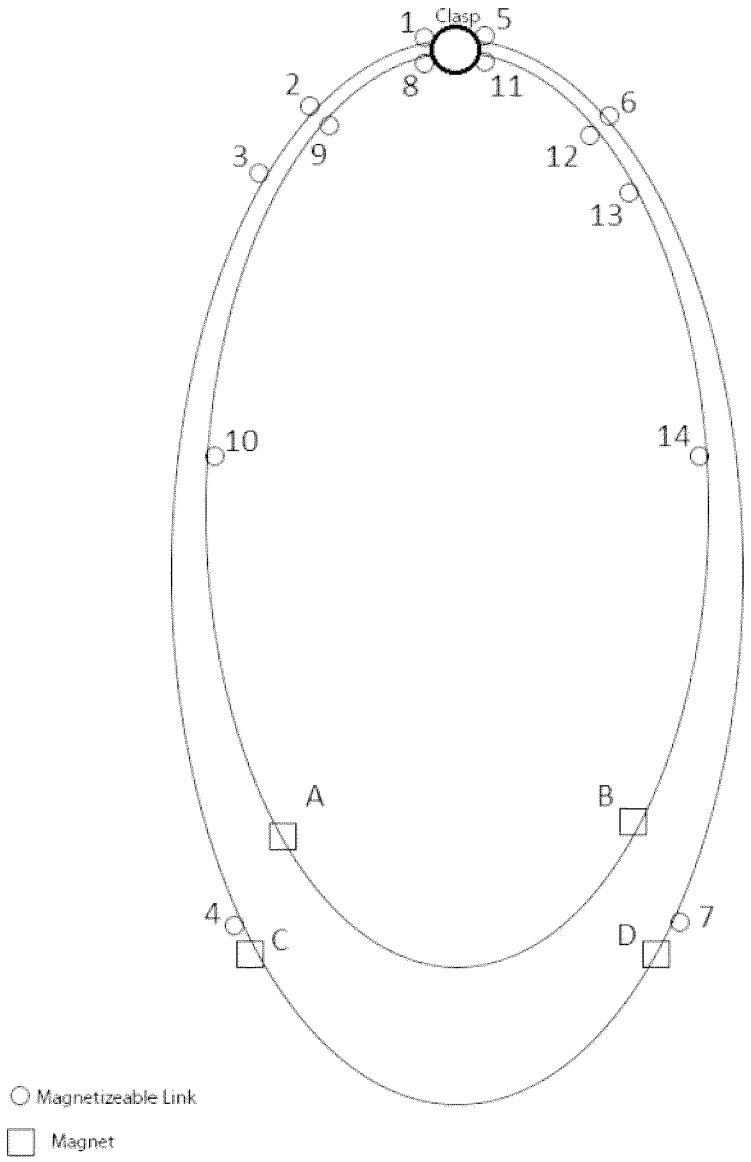
FIG. 3 illustrates a schematic representation of an exemplary embodiment of the invention, wherein the article of jewelry is a necklace having magnetizable links and magnets attached to a chain.

FIG. 3 is a schematic representation of an exemplary article of jewelry of the present invention, wherein the article of jewelry is a necklace. In this exemplary embodiment, the necklace is comprised of two chains that are linked together by a clasp. The two chains are comprised substantially of non-magnetizable links (represented by solid lines). The two chains are about 17.5 inches in length, being linked together at the top center by any suitable clasp mechanism, for example, a hook and eye closure. In this embodiment, four magnetizable links having low magnetic coercivity are located in close proximity to the clasp (links 1, 5, 8, and 11), and the remaining magnetizable links having low magnetic coercivity are interspersed along the chains, as shown by the numbered circles. The chains or ornamental pieces also have magnets having high coercivity attached thereto, as shown by the lettered squares.

Figure 4:
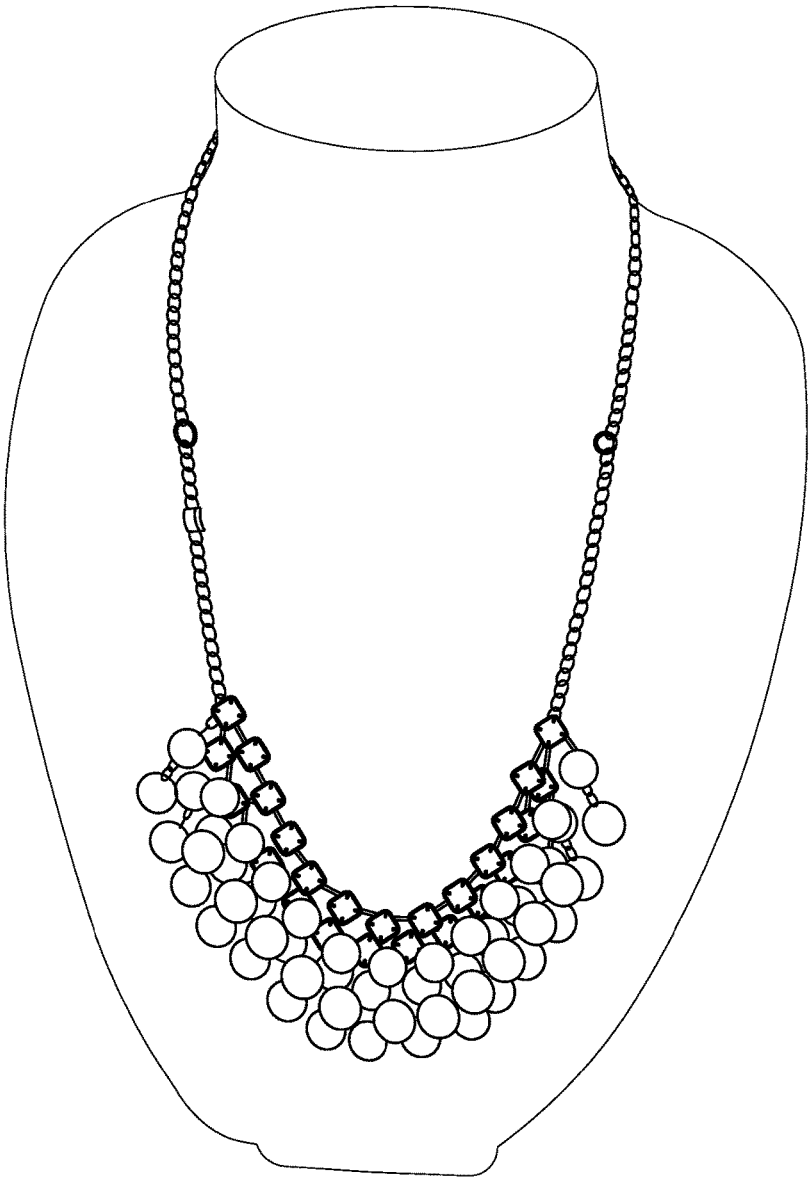
FIG. 4 illustrates an exemplary article of jewelry of the present invention, wherein the article of jewelry is a necklace.

FIG. 4 illustrates an exemplary article of jewelry of the present invention, wherein the article of jewelry is a necklace. In this exemplary embodiment, the necklace has a chain that is comprised substantially of non-magnetizable metal links. Among the non-magnetizable links are interspersed at specific designated locations fourteen magnetizable links having low coercivity.

In this exemplary embodiment, details are provided that are intended to be for illustrative purposes only, and are not meant in any way to be limiting in scope. In this exemplary embodiment, the two chains are each about 17.5 inches in length, and comprises two strands on each side, with all four ends linked together at the top center by any suitable clasp mechanism, for example, a hook and eye closure having a magnetizable link with low coercivity located on either side of the closure on each strand (four in total, designated as links 1, 5, 8, and 11 in FIG. 3). Referring to FIG. 3 for clarity, in the embodiment of FIG. 4, magnetizable link 2 is located about 1.5 inches down the chain from a clasp. Magnetizable link 3 is located about 1 inch further, or about 2.5 inches down from the clasp. Magnetizable links 12 and 13 are located on the opposite end of the chain, magnetizable link 12 being located about 1.5 inches down from the opposite clasp end, and magnetizable link 13 being located about 2.5 inches down from the opposite clasp end. Connected to the chain are two sets of beaded ornaments, and two beads within each set has a magnet attached thereto. Thus, in this embodiment, four beads (two from each set) have a magnet attached thereto.

One of skill in the art would recognize that this is a non-limiting exemplary embodiment provided for illustrative purposes only, and that the article of jewelry could be of various types and configurations.

FIGS. 5A-5E illustrate exemplary embodiment of various configurations that are achieved with a necklace having magnetizable links, two sets of ornaments, and four specific ornaments having a magnet attached thereto. Each description of the figures below describe various configurations that are created from the same exemplary embodiment of the magnetic jewelry, with the different configurations created by the specific placement of the magnetic ornament on various magnetizable links. One of skill in the art would recognize that various configurations or combinations can be realized based on the location of the magnetizable links on the chain, and the placement of different magnets on different magnetizable links. Reference is made to FIG. 3 to illustrate the placement of magnets to magnetizable links.

Figure 5A:
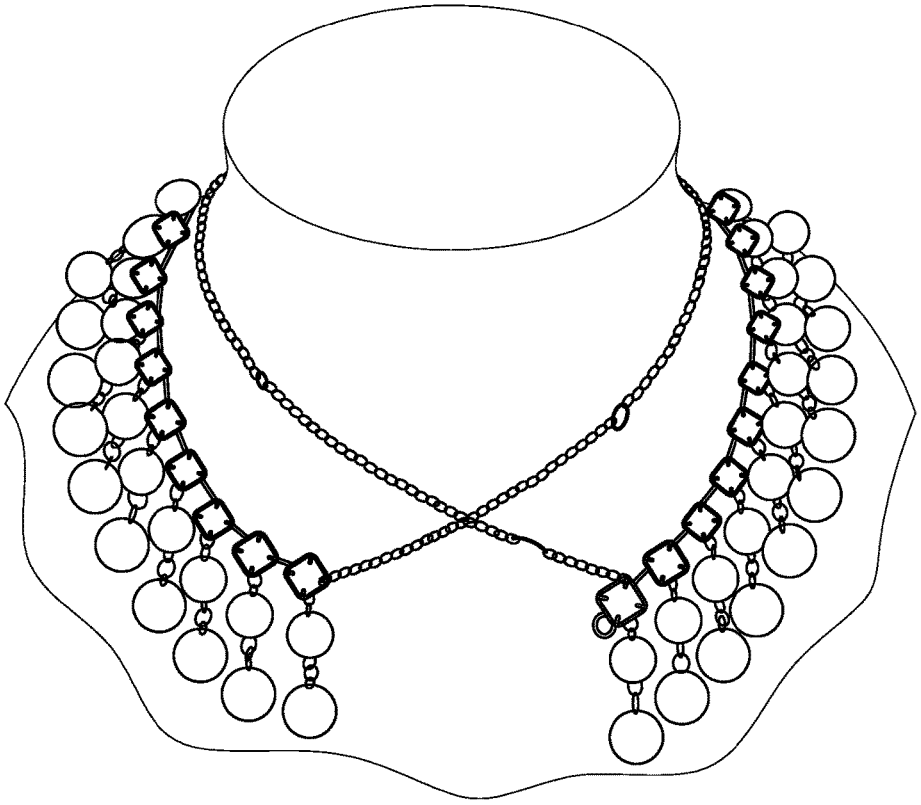
FIG. 5A illustrates an exemplary embodiment of the article of jewelry, wherein the jewelry is a necklace and configured in a peter pan configuration.

FIG. 5A provides for the peter pan configuration, wherein the ornamentation wraps around the neck in a collar-like configuration due to the placement of the magnets on certain magnetizable links. The configuration is achieved by moving the magnets to the appropriate locations. Referring now to FIG. 3, in this exemplary embodiment, the configuration is created by moving magnet A upward to link 2 or 9 to form a half-circle. Magnet D is moved upward in the opposite direction to link 6 or 12 located on the opposite end of the chain to form another half-circle that mirrors the first half circle, resulting in the peter pan configuration.

Figure 5B:
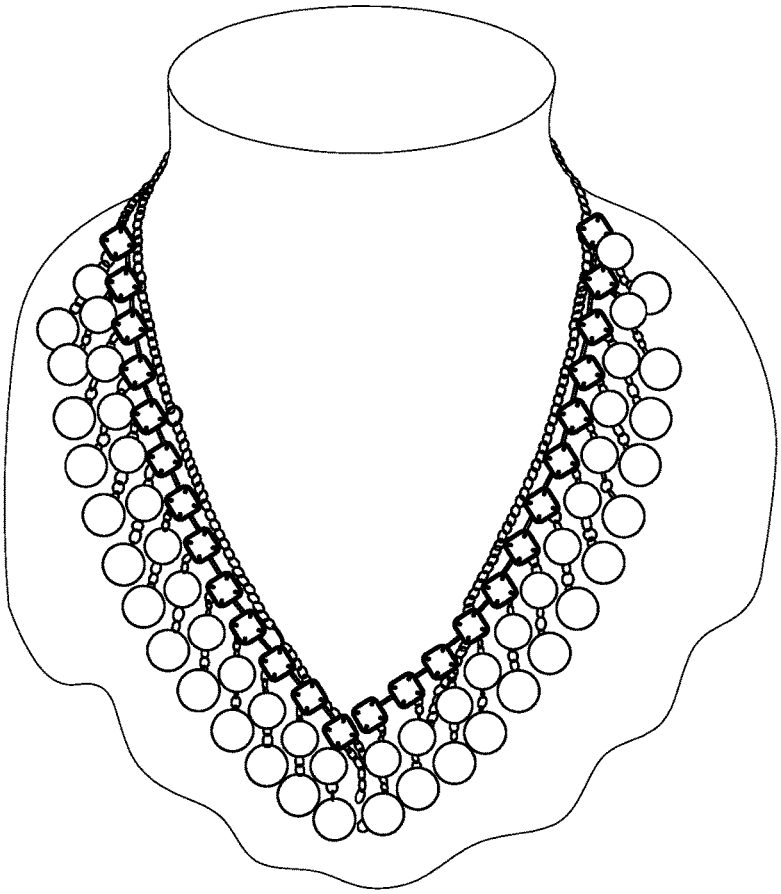
FIG. 5B illustrates an exemplary embodiment of the article of jewelry, wherein the jewelry is a necklace and configured in the V-neck configuration.

FIG. 5B provides for the V-neck configuration, wherein the ornamentation falls loosely around the neck, ending in a point, or V-shape. This configuration is achieved by placing the magnets on the appropriate magnetizable links to achieve the desired configuration. Referring now to FIG. 3, in this exemplary embodiment, magnet A is moved and attached to link 3. Magnet D from a second set is moved and attached to link 13. This leaves two sets of beads dangling unattached, with magnetic ornaments on the end of each set. Magnets B and C are connected together and may slightly overlap. The beads line up to create the V-neck shaped necklace.

Figure 5C:
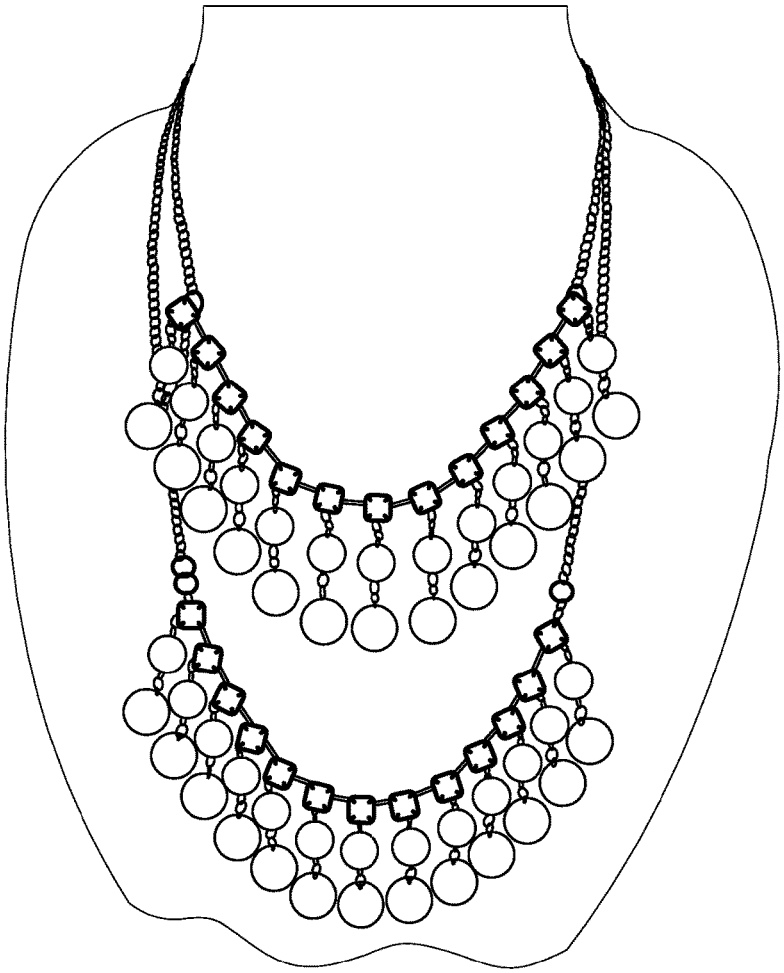
FIG. 5C illustrates an exemplary embodiment of the article of jewelry, wherein the jewelry is a necklace and configured in the statement configuration.

FIG. 5C provides for the statement configuration. This configuration is provided to appear as if two separate chains are worn, but in actuality, the configuration is achieved by the strategic placement of the magnets on appropriate magnetizable links. Referring now to FIG. 3, in this exemplary embodiment, magnet C is moved and attached to link 10. Magnet D is moved and attached to link 14.

Figure 5D:
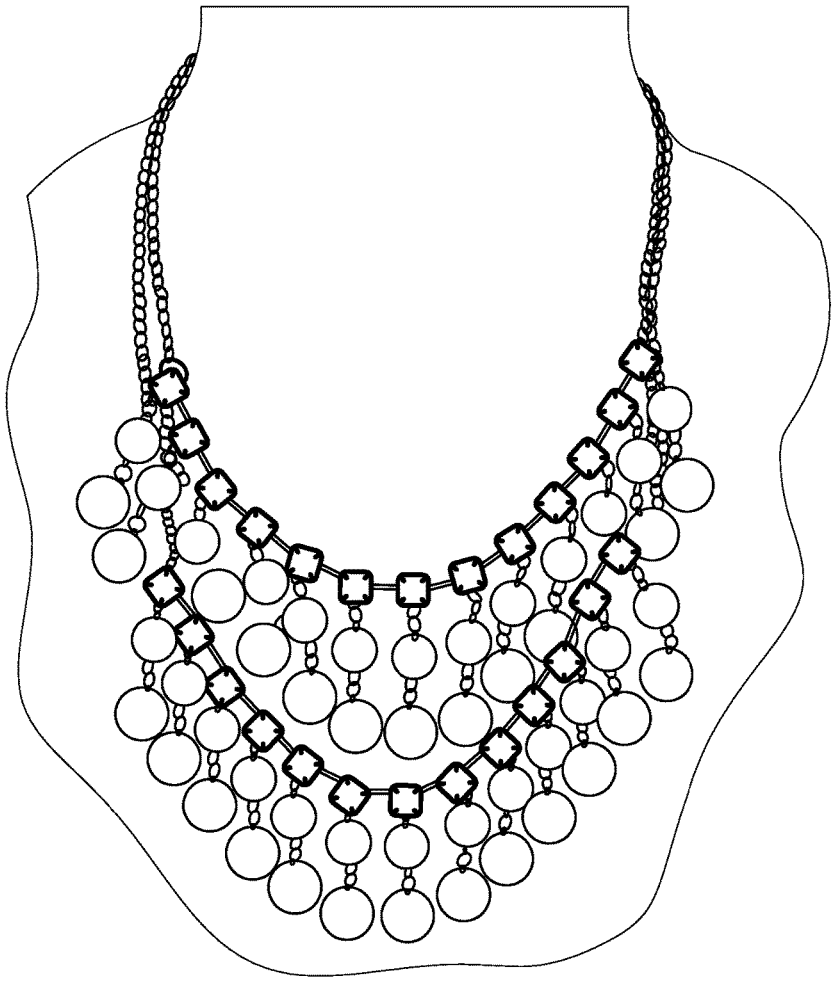
FIG. 5D illustrates an exemplary embodiment of the article of jewelry, wherein the jewelry is a necklace and configured in the Bib configuration.

FIG. 5D provides for the Bib necklace. Referring now to FIG. 3, in this exemplary embodiment, magnet C is moved and attached to link 10 and magnet D is moved and attached to link 14, as was done for the statement configuration of FIG. 5C. In addition magnet A is moved to link 4 and magnet B is moved to link 7, demonstrating the possibility for additional configurations using magnetizable ornaments.

Figure 5E:
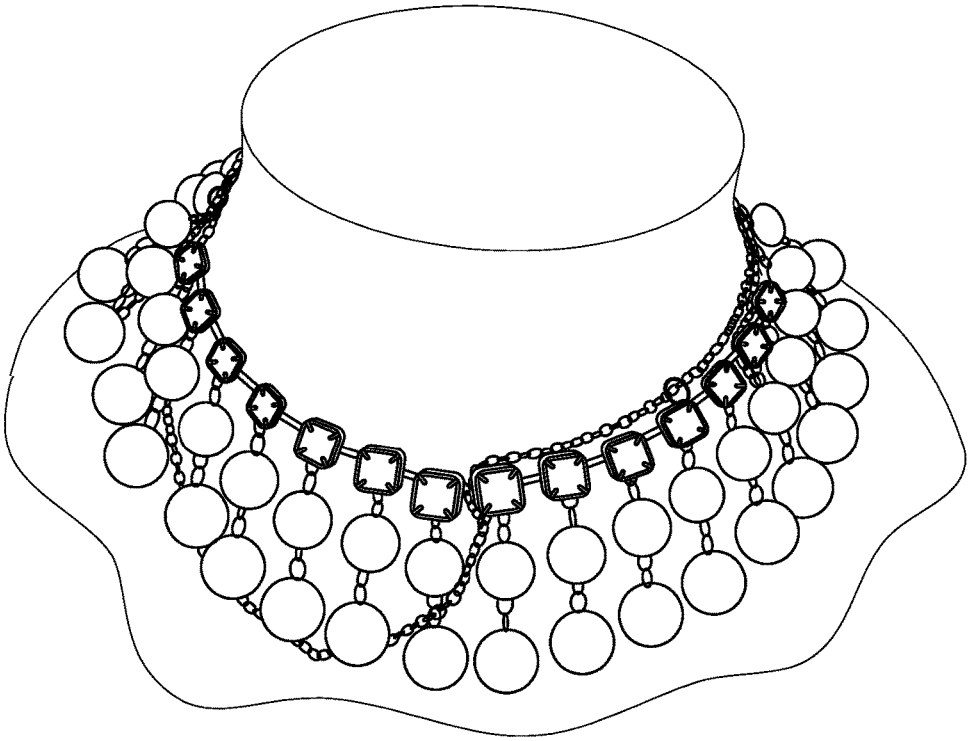
FIG. 5E illustrates an exemplary embodiment of the article of jewelry, wherein the jewelry is a necklace and configured in the choker configuration.

FIG. 5E provides for the choker configuration, wherein the necklace is tighter to the neckline. This configuration is achieved by placing the magnets onto appropriately placed magnetizable links. Referring now to FIG. 3, in this exemplary embodiment, the configuration is created by moving magnet A to link 8, magnet D to link 6, and moving magnet C to magnet B.

In some embodiments of the invention, jewelry is provided, wherein the jewelry is a necklace, and wherein the necklace is comprised of a metal chain, the metal chain being substantially comprised of non-magnetizable metal links, including gold, silver, platinum, aluminum or other common metals used in necklace chains. Interspersed within the chain are designated links that are magnetizable, such that they are attracted to magnetic force. These links are created from metals such as iron, nickel, cobalt, or combinations thereof. These links are optionally plated in the non-magnetizable metal, such that the links appear to be of the same material as the remaining links, but they retain their magnetizable character.

The necklace further comprises magnets placed behind ornamentation, such that the magnets are concealed. The ornamentation can include wood, beads, stones, shells, minerals or other commonly used ornaments for the ornamentation of necklaces. The magnets are placed in designated locations in order to enable the re-configuration of the necklace.

The magnets can be placed near the magnetizable chain links in order to create new configurations of the necklace. Such configurations include peter pan, Bib, choker, or V-neck. The wearer of the necklace moves the chain into place in order to create the necklace configuration of choice. The magnetizable links and the magnets are placed only at certain designated places along the necklace chain, which provides for placement into the various configurations with ease. Because the majority of the necklace comprises the non-magnetic material, the magnets only attach to magnetizable links, and various configurations are created. Furthermore, the necklace is entirely self-contained, meaning that additional chains, links, pendants, or other ornamental items are not required in order to modify the configuration.

While the foregoing is directed to aspects of the present disclosure, other and further aspects of the disclosure may be devised without departing from the basic scope thereof, and the scope thereof is determined by the claims that follow.

What is claimed:

1. A jewelry article having a first configuration with an associated first wearable length and a second configuration with an associated second wearable length, the second wearable length being different than the first wearable length, said article comprising:

a first chain and a second chain, each of the first chain and the second chain having two ends, a plurality of non-magnetizable links, a first end portion, a middle portion, and a second end portion, a plurality of magnetizable links, and a plurality of magnets, the plurality of magnets and the plurality of magnetizable links being interspersed within each of the first chain and the second chain so as to allow a user to selectively attach at least one of the plurality of magnets to at least one of the plurality of magnetizable links to change the jewelry article from the first configuration to the second configuration, wherein the first chain comprises three magnetizable links of the plurality of magnetizable links (1, 2, 3) being interspersed on the first end portion of the first chain, two magnetizable links of the plurality of magnetizable links (5, 6) being interspersed on the second end portion of the first chain, two magnetizable links of the plurality of the magnetizable links (4, 7) being interspersed on the middle portion of the first chain, and a first and a second magnet of the plurality of magnets (C, D) being interspersed on the middle portion of the first chain, wherein the second chain comprises three magnetizable links of the plurality of magnetizable links (8, 9, 10) being interspersed on the first end portion of the second chain, four magnetizable links of the plurality of magnetizable links (11, 12, 13, 14) being interspersed on the second end portion of the second chain, and a first and a second magnet of the plurality of magnets (A, B) being interspersed on the middle portion of the second chain; and a clasp configured to releasably secure the two ends of the first chain relative to the two ends of the second chain, wherein the first configuration is a necklace, and wherein none of the plurality of magnets selectively attaches to another of the plurality of magnets or to the plurality of magnetizable links, and wherein the second configuration is a peter pan necklace, wherein the first magnet on the second chain selectively attaches to one of the magnetizable links on the first end portion of the first chain or to one of the magnetizable links on the first end portion of the second chain, and the second magnet on the first chain selectively attaches to one of the magnetizable links on the second end portion of the first chain or to one of the magnetizable links on the second end portion of the second chain.

2. The jewelry article of claim 1, wherein the plurality of non-magnetizable links comprise a metal selected from the group consisting of gold, white gold, silver, aluminum, and platinum.

3. The jewelry article of claim 1, wherein the plurality of magnetizable links comprise a metal selected from the group consisting of iron, cobalt, nickel, and alloys thereof.

4. The jewelry article of claim 3, wherein at least one of the plurality of magnetizable links is plated with a non-magnetizable metal selected from the group consisting of gold, silver, and platinum.

5. The jewelry article of claim 1, wherein the plurality of magnets is affixed to an ornamental feature.

6. The jewelry article of claim 1, wherein the plurality of magnets is placed within an ornamental feature.

7. A method of re-configuring jewelry, the method comprising:

providing the article of jewelry of claim 1; and moving at least one of the plurality of magnets to at least one of the plurality of magnetizable links, wherein the at least one of the plurality of magnetizable links is attracted to a magnetic field created by the at least one of the plurality of magnets, and wherein the article of jewelry is held into place in a new configuration due to the magnetic attraction.

8. The method of claim 7, wherein the jewelry article is configured in a peter pan configuration, a V-neck configuration, a statement configuration, a bib configuration, or a choker configuration.

9. The jewelry article of claim 1, further comprising a third configuration, wherein the third configuration is a V-neck necklace, wherein the first magnet on the second chain selectively attaches to one of the magnetizable links on the first end portion of the first chain, the second magnet on the second chain selectively attaches to the first magnet on the first chain, and the second magnet on the first chain selectively attaches to one of the magnetizable links on the second end portion of the second chain.

10. The jewelry article of claim 9, further comprising a fifth configuration, wherein the fifth configuration is a bib necklace, wherein the first magnet on the second chain selectively attaches to one of the magnetizable links on the middle portion of the first chain, the second magnet on the second chain selectively attaches to one of the magnetizable links on the middle portion of the first chain, the first magnet of the first chain selectively attaches to one of the magnetizable links on the first end portion of the second chain, and the second magnet of the first chain selectively attaches to one of the magnetizable links on the second end portion of the second chain.

11. The jewelry article of claim 9, further comprising a sixth configuration, wherein the sixth configuration is a choker necklace, wherein the first magnet of the second chain selectively attaches to one of the magnetizable links on the first end portion of the second chain, the second magnet of the second chain selectively attaches to the first magnet of the first chain, and the second magnet of the first chain selectively attaches to one of the magnetizable links on the second end portion of the first chain.

12. The jewelry article of claim 1, further comprising a fourth configuration, wherein the fourth configuration is a statement necklace, wherein the first magnet of the first chain selectively attaches to one of the magnetizable links on the first end portion of the second chain and the second magnet on the first chain selectively attaches to one of the magnetizable links on the second end portion of the second chain.

* * * * *